United States Patent [19]

Bost

[11] 4,172,527

[45] Oct. 30, 1979

[54] BEARING SORTING DEVICE

[75] Inventor: John R. Bost, Laurens, S.C.

[73] Assignee: Byars Machine Company, Laurens, S.C.

[21] Appl. No.: 857,270

[22] Filed: Dec. 5, 1977

[51] Int. Cl.[2] ..... B07C 5/06

[52] U.S. Cl. ..... 209/668; 209/670

[58] Field of Search ..... 209/667, 668, 670, 673

[56] References Cited

U.S. PATENT DOCUMENTS

| | | | |
|---|---|---|---|
| 490,274 | 1/1893 | Doolittle | 209/670 |
| 707,701 | 8/1902 | Jackson | 209/668 |
| 820,775 | 5/1906 | Frisby | 209/668 |
| 853,066 | 5/1907 | Crellin | 209/670 X |
| 2,343,042 | 2/1944 | Barry | 209/670 X |
| 3,770,123 | 11/1973 | Mraz | 209/670 X |

*Primary Examiner*—Joseph J. Rolla

*Attorney, Agent, or Firm*—Bailey, Dority & Flint

[57] ABSTRACT

An apparatus for sorting round bearings which includes a pair of elongated cylinders that are rotatably supported so that the longitudinal axes thereof are diverging defining a sorting gap between the surfaces of the cylinders. The cylinders are carried on an incline with a driving member connected to one end thereof for rotating the cylinders in opposite directions. Timing gears connecting the lower ends of the cylinders together for positively synchronizing the rotation of the cylinders relative to each other so that the same points on the cylinders appear at the sorting gap on each revolution of the cylinders. The bearings which are to be sorted are fed onto the cylinders and moved down the sorting gap until the width of the sorting gap is sufficient to allow them to drop through into receptacles. The cylinders are supported by means of a set of supporting bearings and a set of guide bearings.

6 Claims, 5 Drawing Figures

BEARING SORTING DEVICE

BACKGROUND OF THE INVENTION

Heretofore, in sorting bearings such as needle bearings, they were allowed to slide down between rotating cylinders whose axes were mounted in a diverging manner so as to provide a gradually enlarging gap therebetween. As the bearings slide down the cylinders, they would drop through the cylinders at the point where the width of the gap was slightly greater than the diameter of the bearing. There would be no problem in sorting bearings to accurate and high tolerances if the cylindrical rollers were perfectly cylindrical and they could be driven while maintaining this desired separating gap. However, it is substantially impossible to make a perfectly cylindrical roll and, accordingly, while the variances may not be noticeable to the eye, when sorting bearings to high tolerances such as 0.000010 of an inch, any variance in the roundness of the cylinder causes changes in the width of the sorting gap.

Examples of sorting devices utilizing rotating cylindrical rolls are disclosed in U.S. Pat. Nos. 1,980,517, 2,314,593, and 1,623,275. Each of these devices are utilized for sorting seeds according to predetermined tolerances and none of these devices would be suitable for sorting bearings to high tolerances such as 0.000010 of an inch.

SUMMARY OF THE INVENTION

The invention includes an apparatus for sorting round bearings such as needle bearings according to their diameters. The apparatus includes a pair of elongated cylinders with means for rotatably supporting the cylinders so that the longitudinal axes thereof are diverging and a sorting gap between the surfaces of the cylinder increases from one end to the other. Means is also provided for carrying the cylinders on an incline with the cylinders sloping downwardly from one end to the other end. Drive means are connected to the ends of the cylinders for rotating the cylinders in opposite directions. Timing means connect the other ends of the cylinders together positively synchronizing the rotation of the cylinders relative to each other so that the same points on the cylinders occur at the sorting gap on each revolution of the cylinders. The bearings that are to be sorted are fed adjacent the upper end of the sorting gap and are allowed to slide down between the cylinders until the gap exceeds the diameter of the bearing. The bearing then drops through the gap into a respective receptacle. In one particular embodiment, the timing means connecting the ends of the cylinders together include two gears carried on the ends of shafts extending through the cylinders. The gears are in mesh relation for synchronizing the rotation relative to each other. A first counterbalance bearing is provided for supporting the cylinders by means of the shaft extending therethrough. The majority of the weight of the cylinders and the shafts are supported on these counterbalance bearings. A guide bearing encircles the ends of the cylinders for positively positioning the cylinders relative to each other. These guide bearings have a layer of low coefficient of friction material upon which the cylinders are rotated.

To compensate for the lack of concentricity of the rolls, cylinders are timed by the gears so that variances in the width of the sorting gap are averaged out. Other timing mechanisms such as chains and sprockets or timing belts and sprockets could be utilized in place of the gears for synchronizing the rotation of the cylinders. The effect of timing or compensation for run-out or lack of concentricity of the cylinders is to assure a more uniform sorting gap between the cylinders, so that a high degree of sorting precision can be accomplished such as sorting to within 0.000010 inch whereas without timing, the sorting accuracy is more dependent on the accuracy of the concentricity of the rolls.

Accordingly, it is an important object of the present invention to provide an apparatus for sorting round bearings to a high degree of sorting precision.

Another important object of the present invention is to provide an apparatus which sorts bearings such as needle bearings at a high rate and to a high degree of tolerances.

Still another important object of the present invention is to provide a simple and efficient device for sorting bearings to a high degree of tolerance with a minimum amount of supervision.

These and other objects and advantages of the invention will become apparent upon reference to the following specification, attendant claims, and drawing.

DESCRIPTION OF A PREFERRED EMBODIMENT

Figure 1:
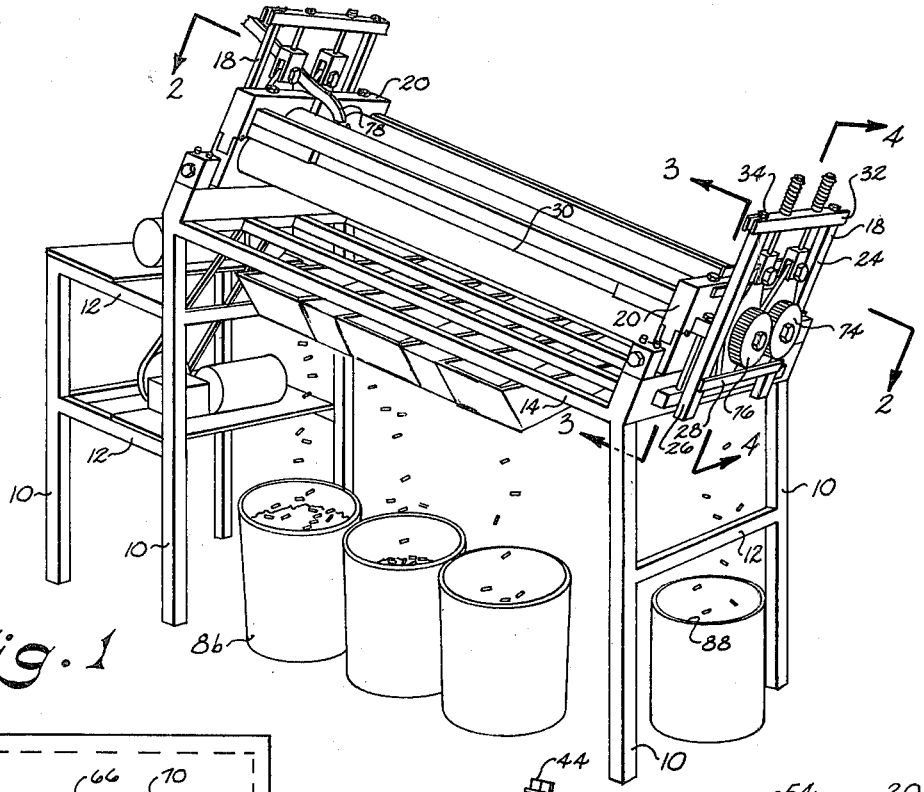
FIG. 1 is a perspective view illustrating a bearing sorting device constructed in accordance with the present invention.

Referring in more detail to FIG. 1 of the drawing, there is illustrated an apparatus for sorting bearings such as needle bearings, ball bearings, and the like. The apparatus includes a stand having vertically extending legs 10 which are suitably braced by cross braces 12. Adjacent the top of the legs 10 are inclined supporting braces 14 which extend upwardly from the lower legs to the upper legs. The braces 14 are inclined at an angle of between 5° and 20° depending on the accuracy of the sorting desired or the particular items being sorted. A pair of elongated cylinders 16 are carried above the incline braces 14 by means of a pair of bearing assemblies 18 and 20. The purpose of the bearing assembly 18 is to support the majority of the weight of the cylinders 16 while the bearing assembly 20 acts primarily as a guide block for accurately positioning the rollers 16 relative to each other. Extending outwardly from the ends of the rollers 16 are shafts 22. Both ends of the cylinders 16 and shafts 22 are supported on the guide bearings 20 and floating bearings 18, respectively.

The floating bearing assembly 18 includes a pair of vertically inclined supporting members 24 and 26 which are joined together by means of a horizontal brace 28 adjacent the bottom thereof. These braces are, in turn, secured by means of a bolt, not shown, to a clamping bar 30 that extends upwardly parallel with the inclined cylinders to similar bearing assemblies 20 and 18 carried adjacent the upper end of the cylinders 16. The bar 30 is shown extending through the guide bearing assembly 20 in FIG. 3.

A more detailed description of the bearing assembly is disclosed in my co-pending patent application, Ser. No. 857,269, entitled, COUNTERBALANCE BEARING ASSEMBLY filed on an even date herewith.

Connected between the upper ends of the inclined members 24 and 26 is a bar 32 which has bolts 34 extending through bifurcated portions adjacent the ends thereof into the top of the inclined members 24 and 26. The purpose of the bifurcated slots or openings in the ends of the horizontal member 32 is to permit the bearing assembly to shift laterally or track according the adjustments which are described more fully below. The bolts 34 which extend through the horizontal member 32 are not drawn tight thereon. Each of the cylinders are supported by means of a flanged self-aligning pillow block bearing 36 through which the shaft 22 which extends through the cylinder 16 is supported. As can be seen, a lower surface of the bearing 36 rides flush against the horizontal bar 28 for receiving the thrust developed by the incline of the cylinders 16.

Figure 3:
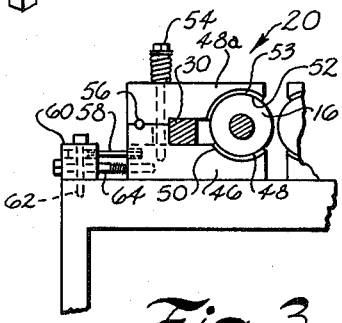
FIG. 3 is a sectional view taken along line 3—3 illustrating in more detail a guide bearing block.

The upper end of the bearing 36 is attached by means of a split clamping mechanism and bolts 38 to a rod 40. The upper end of the rod 40 extends through the horizontally extending member 32. A spring 42 is carried on the upper end of the rod between a head and washer 44 and the horizontal member 32 to counterbalance the weight of the cylinder. The bearing assembly 18 is provided to support the majority of the weight of the cylinders 16. Since it is a counterbalance floating bearing, a very small force can be used for properly aligning the cylinders 16 relative to each other. This aligning force is provided by the guide bearing assembly 20 such as best illustrated in FIG. 3. A guide bearing assembly 20 is provided adjacent each end of the cylinders 16 and includes a pair of space blocks 46 and 48. The block 46 is carried on top of the frame and permitted to slide horizontally thereon for adjustment in aligning the cylinders. Adjacent the inner end of the block 46 is an arcuate surface **48*a* which is provided for receiving the cylinder 16. The surface 48*a* has a layer 50 of low coeffiicient of friction material such as Teflon, carbon graphite, etc. so as to permit the cylinder 16** to rotate thereon with a minimum of wear.

Positioned above the lower block 46 is a top block 48 which also has an arcuate portion 52 removed therefrom. A layer of felt-like material 53 is carried on this arcuate surface so as to provide a wiper for the cylinder as it is rotated. The upper block 48 is secured to the lower block 46 by means of a spring loaded bolt 54. An aligning dowel pin 56 extends in a groove provided at the seams of the upper and lower blocks for maintaining such in proper alignment relative to each other.

In order to adjust the position of the lower block 46 so as to align a cylinder 16, an aligning assembly carried on the left of the frame as illustrated in FIG. 3 is utilized. This aligning assembly includes a push pin 58 which is carried in a block 60 that is, in turn, fixed to the frame by means of a bolt 62. A set screw is carried in the block 60 behind the push pin 58 so that as the set screw is rotated, it forces the push pin 58 to the right as illustrated in FIG. 3. The outer end of the push pin 58 is carried within a bore extending in the lower block 46.

When it is desired to shift the lower guide block 46 to the left as illustrated in FIG. 3, a threaded bolt 64 is rotated. This threaded bolt extends into a threaded bore provided in the lower block 46 and through the block 60.

In other words, the push pin 58 is used for shifting the guide block 46 to the right and the threaded bolt 64 is used for shifting the guide block 46 to the left. By means of the push pin 58 and the bolt 64, the bearing assembly and, accordingly, the cylinder 16 can be accurately positioned.

It is understood that each end of the cylinders 16 have a similar guide block bearing assembly 20 provided thereon and each can be adjusted in the same manner as described in connection with FIG 3.

Means are provided for rotating the cylinders 16 in opposite directions. This means includes a pair of variable speed DC motors 66 and 68. The output of motors 66 and 68 are connected through a gear head 70 and suitable pulleys and belts 72 to the shaft 22 upon which the cylinders are carried. Each of the shafts 22 are rotated by a respective motor.

Timing gears 74 and 76 are carried on the other ends of the shafts 22 in mesh relation with each other so as to synchronize the rotation of the cylinders 16 relative to each other. As a result of the timing gears, the same point on the periphery of the cylinders 16 reaches the sorting gap between the cylinders 16 at the same time during each revolution. The non-concentricity of the cylinders 16 is thus compensated for.

While it is desired to use the most concentric cylinders economically and practically possible, it is substantially impossible to produce a perfectly concentric cylinder. As a result, when two cylinders are rotating relative to each other with a gap provided therebetween, this gap tends to open and close according to the concentricity of the cylinders. Since the rotation of the cylinders 16 are synchronized by the timing gears 74 and 76 relative to each other, the gap at any point along the length of the cylinder is always opening and closing according to a predetermined pattern. By adjusting the position of the cylinders relative to each other, sorting through this elongated gap extending between the cylinders is consistent throughout the sorting process since the sorting gap follows a predetermined pattern.

Figure 2:
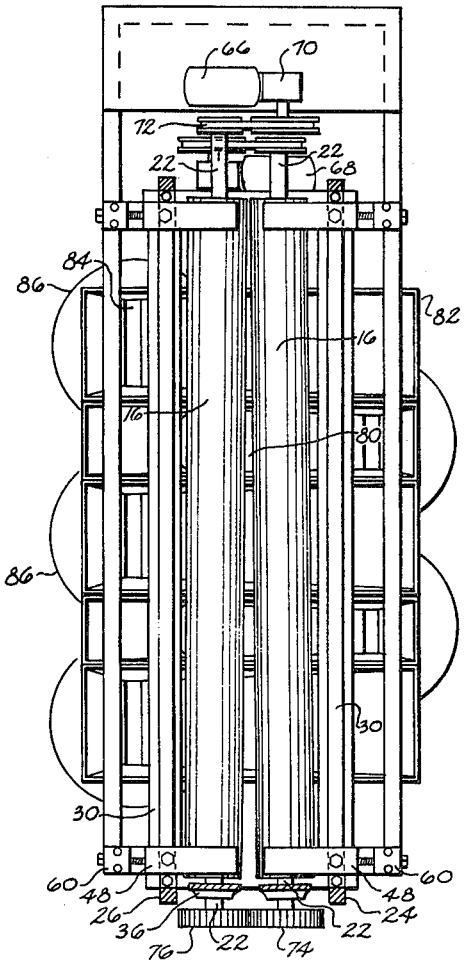
FIG. 2 is a top plan view of the sorting device illustrated in FIG. 1.
Figure 4:
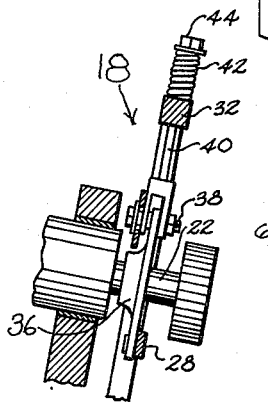
FIG. 4 is a sectional view taken along line 4—4 of FIG. 1 illustrating the floating bearing assembly.
Figure 5:
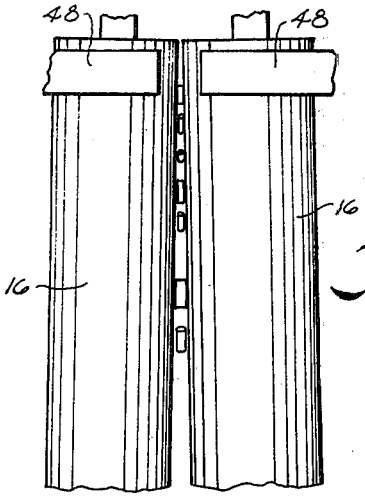
FIG. 5 is a plan view illustrating the bearings passing between a pair of cylindrical rollers and falling through a sorting gap.

Means is provided for feeding the bearings to the sorting gap between the cylinders 16. This means includes a hopper, not shown, and a feed chute 78 which deposits the needle bearings at the upper ends of the cylinders 16. As can best be seen in FIGS. 2 and 5, the longitudinal axes of the rollers 16 are diverging from adjacent the top to the bottom so that the width of the sorting gap 80 provided therebetween increases from the upper end of the cylinders to the lower end.

As the bearings are shifted from the top of the cylinders to the bottom as a result of the incline and the rotation of the cylinders, when the width of the sorting gap exceeds the diameter of a needle bearing, the needle bearing drops through to a sorting pan 82 carried therebelow. The sorting pan 82 has a slotted opening 84 provided adjacent one end thereof through which the bearings drop into a respective receptacle. In operation, the pans 82 are positioned flush adjacent each other with alternate pans positioned on opposite sides of the sorting machine with receptacles provided therebelow.

After the sorting operation has been completed, the bearings having the smallest diameter would be deposited in the first receptacle 86 and the bearings having the largest diameter would be deposited in the last receptacle 88 which normally is carried adjacent the end of the sorting slot 80. In other words, the bearings that drop into the receptacle 88 carried at the end of the sorting machine are all larger than the largest width of the sorting gap 80. The bearings provided in the buckets 86 carried along the side of the sorting machine increase in diameter progressively.

Prior to operating the sorting device, it is desired that the cylinders be indicated for average high and low points. Once the high and low points have been indicated on the periphery of the cylinders 16, the cylinders are brought together so that the timing gears 74 and 76 mesh with each other. The cylinders 16 are arranged so that the high point on, for example, the left hand cylinder in FIG. 2 when it reaches the sorting gap 80 will meet with the low point on the right hand cylinder 16. As a result, a more uniform and continuous sorting gap is provided between the cylinders 16.

While a preferred embodiment of the invention has been described using specific terms, such description is for illustrative purposes only, and it is to be understood that changes and variations may be made without departing from the spirit or scope of the following claims.

What is claimed is:

1. An apparatus for sorting round bearings according to their diameters comprising:

a pair of elongated cylinders, means for rotatably supporting said cylinders so that the longitudinal axis thereof are diverging and a sorting gap between the surfaces of said cylinders increases from one end to the other end, means for carrying said cylinders on an incline with said cylinders sloping downwardly from said one end to said other end, means connected to one end of said cylinders for rotating said cylinders in opposite directions, timing means connecting said cylinders together positively synchronizing the rotation of said cylinders relative to each other so that the same points on said cylinders occur at said sorting gap on each revolution of said cylinders, means for feeding said round bearings to be sorted adjacent the upper end of said sorting gap, a plurality of receptacles carried below said sorting gap for receiving said round bearings as they drop through said sorting gap, guide bearing means for positively positioning said cylinders relative to each other, and said guide bearing means including arcuate supporting surfaces upon which said surfaces of said cylinders are rotatably supported, whereby said bearings travel down said cylinders over said sorting gap until the bearings reach a point where the sorting gap is larger than said bearings and said bearings drop through to one of said receptacles.

2. The apparatus as set forth in claim 1 further comprising:

means for adjusting the width of said sorting gap by moving said supporting surfaces and said cylinders laterally relative to each other.

3. The apparatus as set forth in claim 1 wherein said timing means comprises:

toothed gears carried on the other ends of said cylinders in meshed relation so as to synchronize the rotation of said cylinders relative to each other.

4. The apparatus as set forth in claim 1 further comprising:

a shaft extending through each of said cylinders, first bearings carried on the ends of said shafts, and support means connected to said first bearings for supporting the majority of the weight of said cylinders and shafts.

5. The apparatus as set forth in claim 1 further comprising:

a layer having a low coefficient of friction carried by said supporting surface upon which said cylinders are carried.

6. An apparatus for sorting round bearings according to their diameters comprising:

a pair of out of round elongated cylinders having a high point and low point on the surface thereof, means for rotatably supporting said cylinders so that the longitudinal axis thereof are diverging and a sorting gap between the surfaces of said cylinders increases from one end to the other end, means for carrying said cylinders on an incline with said cylinders sloping downwardly from said one end to said other end, means connected to one end of said cylinders for rotating said cylinders in opposite direction, timing means positively synchronizing the rotation of said cylinders relative to each other so that the high point on one of said cylinders meets the low point of said other cylinder at said sorting gap on each revolution of said cylinders, means for feeding said round bearings to be sorted adjacent the upper end of said sorting gap, a plurality of receptacles carried below said sorting gap for receiving said round bearings as they drop through said sorting gap, a shaft extending through each of said cylinders, first bearings carried on the ends of said shafts, resilient support means connected to said first bearings for supporting the majority of the weight of said cylinders and shafts, and a guide bearing carried on each of said cylinders for positively positioning and supporting said cylinders relative to each other, whereby said bearings travel down said cylinders over said sorting gap until the bearings reach a point where the sorting gap is larger than said bearings and said bearings drop through to one of said receptacles.

* * * * *